US005431270A

United States Patent [19]

Wohlrab et al.

[11] Patent Number: 5,431,270

[45] Date of Patent: Jul. 11, 1995

[54] COIN ACCEPTING APPARATUS

[76] Inventors: Ekhart Wohlrab, Alte Dorfstr. 29, 21684 Stade; Hans-Ulrich Cohrs, Teiledamm 5, 21640 Homeburg; Wilfried Meyer, Apensener Str. 100; Fred Cohrs, Hastedtstr. 42, both of 21614 Buxtehude; Jurgen Deters, Deichstr. 17, 21712 Grossenwohrden; Eginhard Matzeit, Kartner Str. 23, 21680 Stade, all of Germany

[21] Appl. No.: 230,954

[22] Filed: Apr. 21, 1994

[30] Foreign Application Priority Data

May 4, 1993 [DE] Germany ..... 43 14 596.5

[51] Int. Cl.[6] ..... G07D 5/08

[52] U.S. Cl. ..... 194/318; 336/67; 336/210

[58] Field of Search ..... 194/317, 318, 319; 336/65, 67, 210

[56] References Cited

U.S. PATENT DOCUMENTS 3,584,823 6/1971 Andrew et al. ..... 336/210 X
3,905,000 9/1975 Walter ..... 336/210
4,585,936 4/1986 Sellier ..... 250/223
5,078,252 1/1992 Furuya et al. ..... 194/318
5,207,307 5/1993 Waite ..... 194/317

FOREIGN PATENT DOCUMENTS 3810716 11/1989 Germany ..... H05K 7/12

*Primary Examiner*—F. J. Bartuska
*Attorney, Agent, or Firm*—Senniger, Powers, Leavitt & Roedel

[57] ABSTRACT

A coin accepting apparatus. The apparatus includes a pair of generally parallel, spaced-apart plates. The plates define a coin track for receiving and guiding coins wherein each plate has a side facing the coin track and an opposing side facing away from the coin track. The apparatus further includes a sensor on the opposing side of one plate for detecting a characteristic of coins to be validated and first and second retainers on the opposing side of the plate for inhibiting movement of the sensor. The first retainer includes a spring arm for engaging the sensor and biasing the sensor against the opposing side of the plate. The second retainer engages the sensor and constrains movement of the sensor along an axis generally perpendicular to the opposing side of the plate.

13 Claims, 2 Drawing Sheets

COIN ACCEPTING APPARATUS

BACKGROUND OF THE INVENTION

This invention generally relates to vending machines and, particularly, to an electronic coin accepting apparatus for use in a vending machine and including first and second retainers for inhibiting movement of a sensor relative to the coin accepting apparatus.

Generally, coin acceptors validate the presence and value of coins deposited in a vending machine. Various sensors, e.g., inductive, optical and capacitive sensors, detect characteristics or parameters of the coins deposited in a coin track for validating the coins. A typical coin acceptor includes a pair of parallel, spaced-apart plates defining the coin track for receiving the coins and guiding them to a coin receptacle. The acceptor is arranged in a housing of the vending machine and the sensors are positioned on one or both plates defining the coin track.

Conventional mass-produced coin acceptor systems, however, often provide inaccurate coin measurements due to measuring tolerances of the sensor elements. Further, movement of the sensor elements within the coin acceptor exacerbates the errors associated with measuring tolerances. For these reasons, the measuring quality of conventional coin acceptors is significantly limited. Also, continual adjustments to coin acceptor systems are often necessary due to the movement of the sensor elements, thus, increasing cost.

SUMMARY OF THE INVENTION

Among the several objects of this invention may be noted the provision of an improved coin accepting apparatus which inhibits a sensor element on the outside of a coin track plate from shifting laterally; the provision of such an apparatus which inhibits the sensor element from shifting in a plane generally parallel to the coin track plate; the provision of such an apparatus which uniformly biases the sensor element against the coin track plate; the provision of such an apparatus which coaxially aligns sensor elements on both sides of the coin track; the provision of such an apparatus which facilitates connecting the sensor element to a printed circuit board on the outside of the coin track plate; the provision of such an apparatus which permits receiving sealing compound for protecting the sensor element; and the provision of such an apparatus which is economically feasible and commercially practical.

Briefly described, a coin accepting apparatus according to the present invention includes a pair of generally parallel, spaced-apart plates. The plates define a coin track for receiving and guiding coins wherein each plate has a side facing the coin track and an opposing side facing away from the coin track. The apparatus further includes a sensor on the opposing side of one plate for detecting a characteristic of coins to be validated and first and second retainers on the opposing side of the plate for inhibiting movement of the sensor. The first retainer includes a spring arm for engaging the sensor and biasing the sensor against the opposing side of the plate. The second retainer engages the sensor and constrains movement of the sensor along an axis generally perpendicular to the opposing side of the plate.

In another form, the invention is directed to a coin accepting apparatus including a pair of generally parallel, spaced-apart plates. The plates define a coin track for receiving and guiding coins wherein each plate has a side facing the coin track and an opposing side facing away from the coin track. The apparatus includes a pair of sensors for detecting a characteristic of coins to be validated. One sensor is on the opposing side of one plate and the other sensor is on the opposing side of the other plate. The apparatus further includes first and second pairs of retainers for inhibiting movement of the sensors. One first retainer and one second retainer is on the opposing side of one plate and the other first retainer and the other second retainer is on the opposing side of the other plate. Each first retainer includes a spring arm for engaging a corresponding sensor and biasing the sensor against the opposing side of a corresponding plate. Each second retainer engages the corresponding sensor and constrains movement of the sensor along an axis generally perpendicular to the opposing side of the plate.

Alternatively, the invention may comprise various other systems and methods.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION OF THE DRAWINGS

Figure 1:
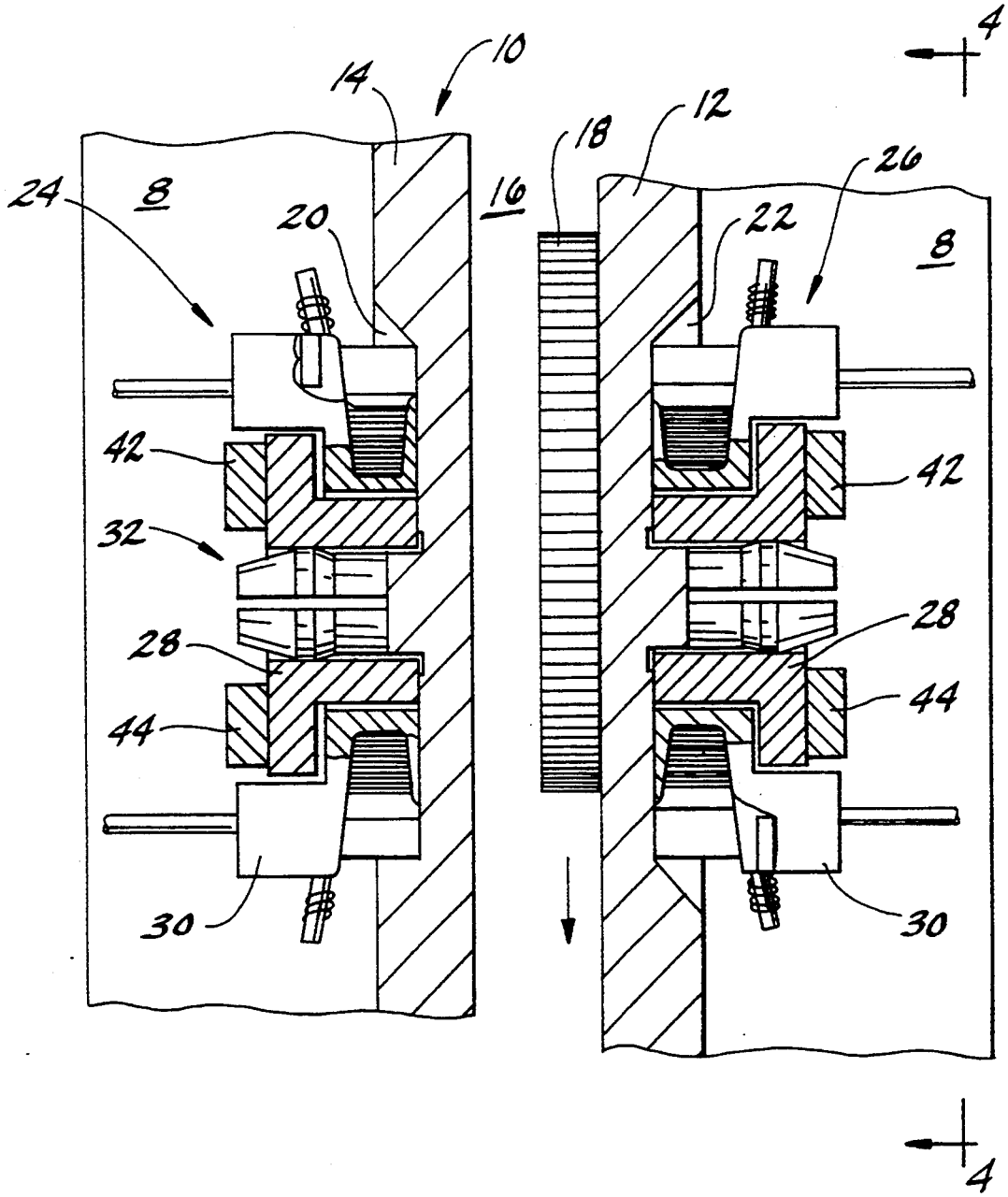
FIG. 1 is a cross-sectional and fragmentary view of a coin accepting apparatus according to one preferred embodiment of the present invention.

FIG. 1 shows a housing 8 of a vending machine having a coin acceptor 10 according to one preferred embodiment of the present invention. The coin acceptor 10 includes a main plate 12 and a track carrier plate 14, both of which are arranged in a generally parallel and spaced-apart manner. The plates 12 and 14 define a coin track 16 for receiving a falling coin 18 and guiding it to a coin receptacle (not shown). Each plate 12, 14 has a side facing the coin track 16 and an opposing side facing away from the coin track 16. A preferred embodiment of the invention includes a recess 20 formed in the opposing side of plate 14 and a recess 22 formed in the opposing side of plate 12. Preferably, plates 12 and 14 are plastic.

As shown in FIG. 1, coin acceptor 10 has a sensor 24 on the opposing side of plate 14 and a sensor 26 on the opposing side of plate 12. The sensors 24 and 26 detect a characteristic or parameter of coin 18 as it falls down coin track 16 for validating and measuring coin 18. Preferably, sensors 24 and 26 are generally cylindrical inductive sensor elements positioned in recesses 20 and 22, respectively. Each recess 20, 22 has conically tapered walls and engages a periphery of the corresponding sensor 24, 26 for inhibiting movement of the corresponding sensor 24, 26 in a plane generally parallel to each plate 14, 12. In a preferred embodiment of the invention, each recess 20, 22 constitutes a second retainer.

Sensor 24 generally comprises an annular shell type core 28 of ferrite and a coil 30 disposed around the annular core 28. Annular core 28 is cylindrical in shape proximate recess 20 and has a flange on the portion distally located from recess 20. Annular core 28 receives a stud 32 which projects from plate 14 and which is adapted to be received by annular core 28. Preferably, the stud 32 is centrally located within recess 20. Stud 32 engages annular core 28 and, thus, constrains movement of sensor 24 along an axis generally perpendicular to the opposing side of plate 14. In this manner, stud 32 inhibits movement of sensor 24 in a plane generally parallel to plate 14. In a preferred embodiment of the invention, stud 32 constitutes a member projecting from plate 14 and also constitutes a second retainer.

Likewise, sensor 26 generally comprises annular core 28 and coil 30 disposed around annular core 28. Annular core 28 receives stud 32 projecting from plate 12. Stud 32 engages annular core 28 and, thus, constrains movement of sensor 26 along an axis generally perpendicular to the opposing side of plates 12. In this manner, stud 32 inhibits movement of sensor 26 in a plane generally parallel to plate 12.

Figure 2:
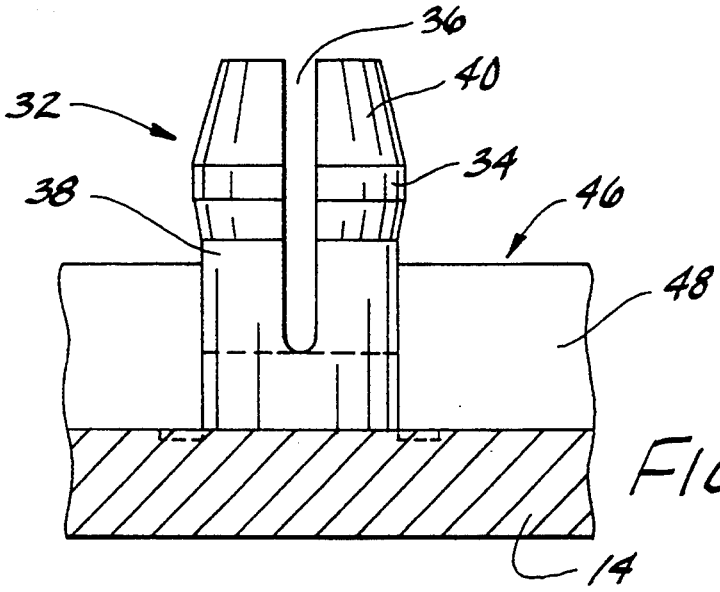
FIG. 2 is an enlarged and fragmentary side view of a stud according to one preferred embodiment of the invention.
Figure 3:
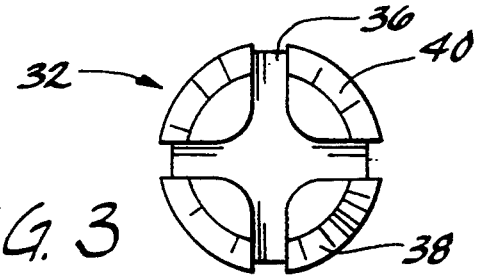
FIG. 3 is an enlarged top view of the stud of FIG. 2.

Referring to FIG. 2, one stud 32 will be described projecting from and integrally formed with plate 14. Stud 32 is generally circular in its outer circumference and includes an enlarged portion 34. The enlarged portion 34 is sized so that its circumference is greater than an inner circumference of annular core 28. A cross-shaped slot 36 (shown in more detail in FIG. 3) is axially formed in stud 32 from a free end so that four sector-like spring arms 38 are formed spaced apart by the slot 36. Further, the spring arms 38 of stud 32 are conically tapered in an upper portion 40 for facilitating insertion of stud 32 in annular core 28. When annular core 28 receives stud 32, the spring arms 38 are compressed in a radial direction and stud 32 secures annular core 28 to plate 14 by an interference fitting. In this manner, stud 32 engages sensor 26 and constrains movement thereof along an axis generally perpendicular to the opposing side of plate 14 thereby inhibiting movement of sensor 26 in a plane generally parallel to plate 14.

In a like manner, stud 32 engages sensor 24 and constrains movement thereof along an axis generally perpendicular to the opposing side of plate 12 thereby inhibiting movement of sensor 24 in a plane generally parallel to plate 12.

As described above, two inductive sensors, such as sensors 24 and 26, are frequently positioned opposite each other on plates 12 and 14, respectively. In such an embodiment, coin acceptor 10 provides improved measurements if sensor 24 is aligned with sensor 26. Preferably, stud 32 projecting from plate 12 and stud 32 projecting from plate 14 are coaxial for achieving the desired alignment of sensors 24 and 26.

Referring again to FIG. 1, spring arms 42 and 44 engage the flange portion of annular cores 28. In turn, the flange portion of annular cores 28 biases coils 30 against the bottom of each recess 20, 22. Preferably, the present invention provides two parallel spring arms 42 and 44 on each side of coin acceptor 10 to uniformly contact inductive sensor element 26 on plate 12 and to uniformly contact inductive sensor element 24 on plate 14.

Figure 4:
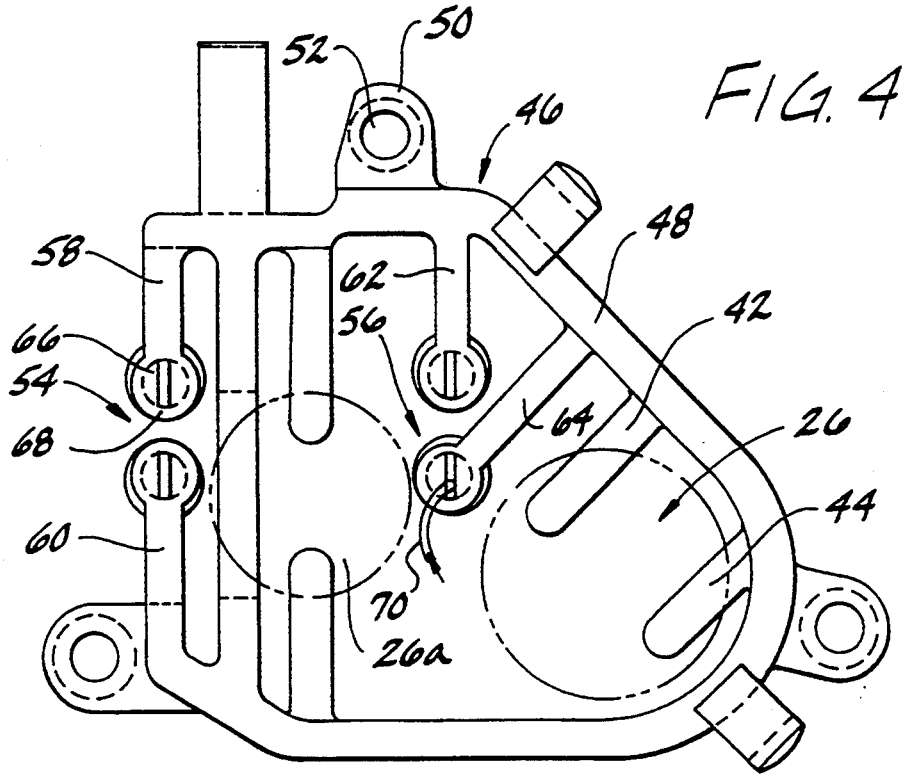
FIG. 4 is a side view of the coin accepting apparatus of FIG. 1 taken generally along line 4—4.

FIG. 4 illustrates a view of a retainer 46 taken generally along line 4—4 of FIG. 1. In addition to spring arms 42 and 44, the retainer 46 comprises a frame 48. Each spring arm 42, 44 preferably extends inwardly from the frame 48 and has one free end and another end fixed to frame 48. Frame 48 further includes three shoulders 50 with screw holes 52 formed on the outside of frame 48 for fastening retainer 46 to plate 12. Retainer 46 engages sensor 26 (shown in phantom) and biases it against the opposing side of plate 12 thereby inhibiting lateral movement of sensor 26 relative to plate 12. As shown in FIG. 4, retainer 46 may also secure another inductive sensor element 26*a* (shown in phantom) on the corresponding plate 12 (not shown in FIG. 4) in a like manner. In a preferred embodiment of the invention, another retainer 46 secures sensor 24 on plate 12.

Alternatively, coin acceptor 10 according to the present invention includes several relatively small sensor elements, e.g., a phototransistor or a light-emitting diode (LED). Generally, optical elements such as LED's or phototransistors have cylindrical, slightly conically tapering bodies consisting of a transparent plastic material. As shown in FIG. 4, a pair of electro-optical elements 54 and a pair of electro-optical elements 56 are positioned with respect to coin track 16 by spring arms 58, 60 and 62, 64, respectively. The spring arms 58 to 64 bias the electro-optical pairs 54 and 56 against plate 12, thus, inhibiting their lateral movement.

However, relatively small sensor elements, such as electro-optical pairs 54 and 56, may be almost completely covered by a spring arm. For this reason, a preferred embodiment of the invention provides spring arms 58 to 64 with a widened-out portion at their free ends. The widened-out portions include an opening 68 in which connection wires, such as a wire 70, are positioned. Thus, the wire 70, or other connection wires, can be soldered to a printed circuit board (not shown) which is positioned on the opposing side of plate 12 in a simple manner. Retainer 46 on plate 14 may also secure additional electro-optical sensors in a similar manner.

FIG. 4 further shows that frame 48, in combination with plate 14 or plate 12, defines a volume forming an enclosure. Such an enclosure serves as a casting form for limiting liquid sealing compound for sealing sensor element 24 or 26 arranged inside of frame 48. The sealing compound protects sensor elements 24 and 26 from environmental influences. This is especially advantageous for coin accepting systems which are to be used outdoors.

In view of the above, it will be seen that the several objects of the invention are achieved and other advantageous results attained.

As various changes could be made in the above systems without departing from the scope of the invention, it is intended that all matter contained in the above description and shown in the accompanying drawings shall be interpreted as illustrative and not in a limiting sense.

What is claimed is:

1. A coin accepting apparatus comprising:

a pair of generally parallel, spaced-apart plates defining a coin track for receiving and guiding coins, each plate having a side facing the coin track and an opposing side facing away from the coin track;

a sensor on the opposing side of one plate for detecting a characteristic of coins to be validated;

a first retainer on the opposing side of the one plate and including a spring arm for engaging the sensor and biasing the sensor against the opposing side of the one plate thereby inhibiting lateral movement of the sensor relative to the plate; and a second retainer on the opposing side of the one plate engaging the sensor and constraining movement of the sensor along an axis generally perpendicular to the opposing side of the one plate thereby inhibiting movement of the sensor in a plane generally parallel to the plate.

2. The apparatus of claim 1 wherein the first retainer comprises a frame attached to the opposing side of the one plate, wherein the spring arm has one end fixed to the frame and a free end extending from the frame and engaging the sensor, and wherein the second retainer includes a member projecting from the plate.

3. The apparatus of claim 2 wherein the free end of the spring arm comprises a section having an opening in which connection wires from the sensor are positioned.

4. The apparatus of claim 2 wherein the frame and the one plate define a volume forming an enclosure around the sensor for receiving sealing compound for protecting the sensor.

5. The apparatus of claim 1 wherein the opposing side of the one plate has a recess for receiving the sensor, the recess inhibiting movement of the sensor in a plane generally parallel to the plate.

6. The apparatus of claim 5 wherein the recess engages a periphery of the sensor and constrains movement of the sensor along an axis generally perpendicular to the opposing side of the one plate.

7. The apparatus of claim 5 wherein the sensor comprises an inductive coil disposed around an annular ferrite shell type core and positioned within the recess and wherein the second retainer comprises a stud centrally located within the recess and projecting from the opposing side of the one plate adapted to be received by the annular core.

8. The apparatus of claim 7 wherein the stud has an enlarged portion slotted in a cross-shaped pattern and wherein the enlarged portion has a circumference greater than an inner circumference of the annular core and wherein the annular core compresses the enlarged portion of the stud when the annular core receives the stud whereby the stud secures the annular core to the one plate by an interference fitting.

9. The apparatus of claim 8 wherein the stud has a generally conical tip thereby facilitating insertion of the stud in the annular core.

10. The apparatus of claim 1 further comprising a second sensor on the opposing side of the one plate for detecting another characteristic of the coins to be validated.

11. The apparatus of claim 10 wherein the second sensor comprises a photoelectric sensing device.

12. A coin accepting apparatus comprising:

a pair of generally parallel, spaced-apart plates defining a coin track for receiving and guiding coins, each plate having a side facing the coin track and an opposing side facing away from the coin track;

a pair of sensors for detecting a characteristic of coins to be validated, one sensor being on the opposing side of one plate and the other sensor being on the opposing side of the other plate;

a first pair of retainers, one first retainer being on the opposing side of the one plate and the other first retainer being on the opposing side of the other plate, each first retainer including a spring arm for engaging a corresponding sensor and biasing the sensor against the opposing side of a corresponding plate thereby inhibiting lateral movement of the sensor relative to the plate; and a second pair of retainers, one second retainer being on the opposing side of the one plate and the other second retainer being on the opposing side of the other plate, each second retainer engaging the corresponding sensor and constraining movement of the sensor along an axis generally perpendicular to the opposing side of the plate thereby inhibiting movement of the sensor in a plane generally parallel to the plate.

13. A vending machine comprising:

a housing; and a coin accepting apparatus in the housing, said coin accepting apparatus comprising:

a pair of generally parallel, spaced-apart plates defining a coin track for receiving and guiding coins, each plate having a side facing the coin track and an opposing side facing away from the coin track;

a sensor on the opposing side of one plate for detecting a characteristic of coins to be validated;

a first retainer on the opposing side of the one plate and including a spring arm for engaging the sensor and biasing the sensor against the opposing side of the one plate thereby inhibiting lateral movement of the sensor relative to the plate; and a second retainer on the opposing side of the one plate engaging the sensor and constraining movement of the sensor along an axis generally perpendicular to the opposing side of the one plate thereby inhibiting movement of the sensor in a plane generally parallel to the plate.

* * * * *